US005738239A

United States Patent [19]

Triglia

[11] Patent Number: 5,738,239

[45] Date of Patent: Apr. 14, 1998

[54] TRASH CONTAINER LINER DISPENSING SYSTEM

[75] Inventor: Benito Triglia, Peekskill, N.Y.

[73] Assignee: Innovative Product Development Corp., Yorktown Heights, N.Y.

[21] Appl. No.: 743,282

[22] Filed: Nov. 4, 1996

[51] Int. Cl.[6] ..... B65D 25/16

[52] U.S. Cl. ..... 220/407; 206/815; 220/908

[58] Field of Search ..... 220/407, 908; 206/815

[56] References Cited

U.S. PATENT DOCUMENTS

| | | |
|---|---|---|
| 3,451,453 | 6/1969 | Heck . |
| 4,349,123 | 9/1982 | Yang . |
| 4,798,363 | 1/1989 | Cortesi . |
| 4,850,507 | 7/1989 | Lemongelli et al. . |
| 4,955,505 | 9/1990 | Battaglia . |
| 5,031,793 | 7/1991 | Chen et al. . |
| 5,115,935 | 5/1992 | Lemongelli . |
| 5,183,157 | 2/1993 | Darden . |
| 5,295,607 | 3/1994 | Chang . |
| 5,322,180 | 6/1994 | Ker . |
| 5,505,334 | 4/1996 | Triglia . |

*Primary Examiner*—Joseph M. Moy
*Attorney, Agent, or Firm*—Nolte, Nolte, and Hunter, P.C.

[57] ABSTRACT

A waste container contains at the bottom, a panel fastened on a base forming between them a tube having one end blocked and the other end open. A slot in the panel extends the length of the tube and has an open end beyond the open end of the tube. Finger grips in the panel beyond the open end of the tube enable one to tilt up the open end of the slot for simultaneously loading a roll of liner bags in the tube and one bag from the roll in the slot by the open ends of the tube and slot.

12 Claims, 5 Drawing Sheets

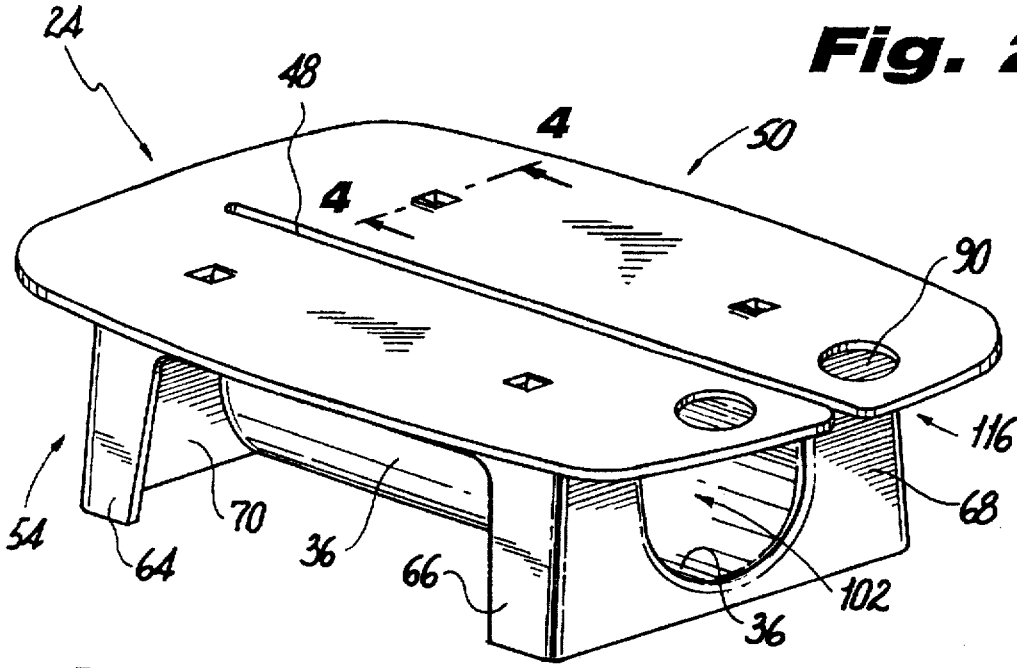
Fig. 2
Fig. 3
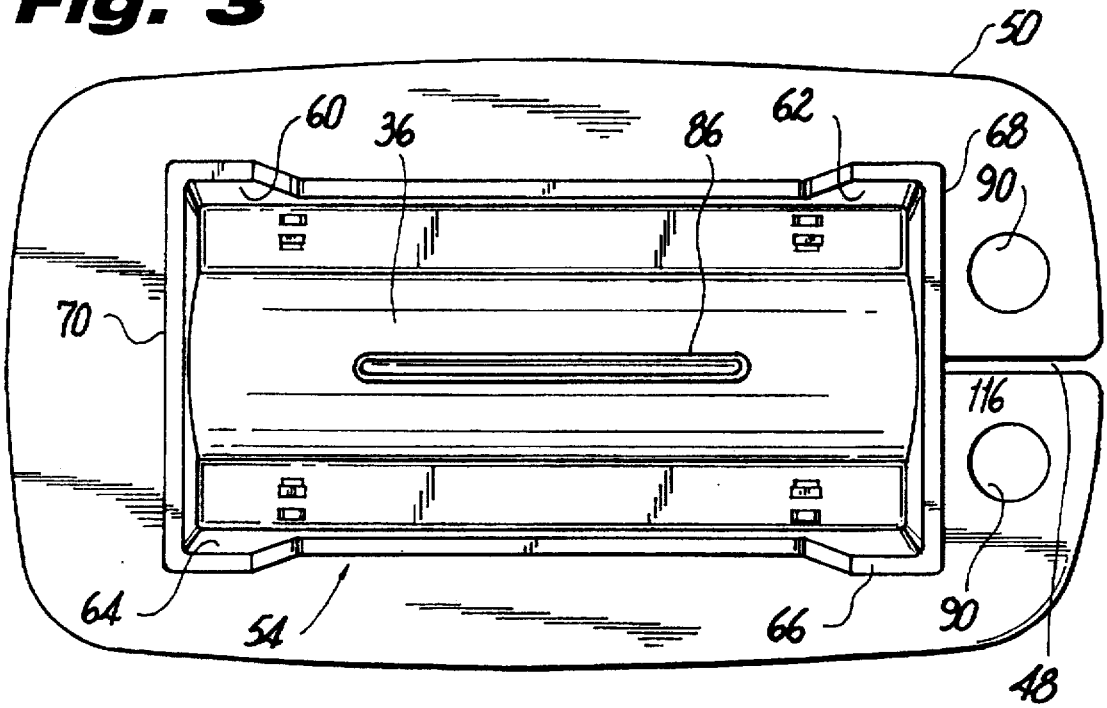
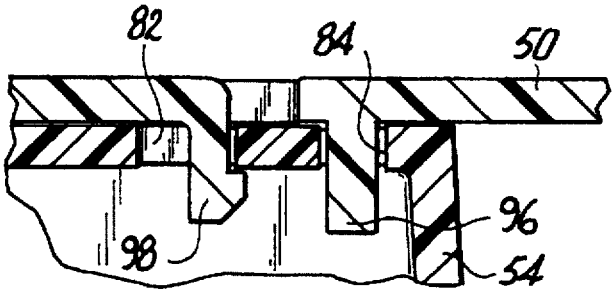
Fig. 4

50
48
90
90
42
34
104
84
70
164
82
82
58
54
82
66
84
58
70
36
60
120
62
102
36
106

TRASH CONTAINER LINER DISPENSING SYSTEM

BACKGROUND OF THE INVENTION

1. Field of the Invention

The invention relates to waste container liner replacement systems, more specifically to a waste container dispenser that supplies flexible concatenated disposable liners within the waste container, wherein disposable plastic bags are delivered in series, one at a time, to the interior of the container from a gathering of the bags, for lining the container. The receptacle may be reloaded with the plastic bags while it is in the container, or may be removed from the container for filling.

2. Description of the Prior Art

Waste container liner replacement system art is replete with designs for supplying the liner from the bottom of the container by pulling the new liner up by the bottom of the full used bag.

U.S. Pat. No. 3,451,453 patented Jun. 24, 1969 by E. E. Heck describes a horizontal wall spaced from the bottom wall of the container by a plurality of legs Which rest on the bottom wall. A longitudinal slot within the horizontal wall is provided for passing the liners up in the container from below the horizontal wall. A pair of parallel, vertical walls, depending from the bottom of the horizontal wall, one on each side of the slot, parallel the slot. The parallel walls are spaced apart sufficiently to closely receive a roll of plastic bag liners or a box containing the roll.

At each end of this trough of parallel walls is a latch made by a curved member or by a pair of downward depending triangularly shaped walls with bottom lugs. The latches engage the bottom edges of the longitudinal ends of the roll or box in order to support the roll or box next to the horizontal wall between the time that the roll is loaded into the trough, and the time that the horizontal wall is set into the bottom of the container.

The latches are forcibly deflected back in order to load the roll into the trough. The latches predetermine the length of the roll or box.

In order to reload the trough with new bags or a box, the operator reaches into the container, inserts his or her fingers into the slot and withdraws the horizontal wall from the container. It is clear that a portion of the slot must be wide enough to accommodate the fingers, and the horizontal wall should be in balance or it could rotate about the slot during withdrawal and hurt the fingers.

The first bag from a new roll or box is fished through the slot from the bottom, and the roll or box is installed in the trough. The horizontal wall is then lowered into place on its legs, in the container. Holding the horizontal wall for lowering can be done by inserting one or more fingers in the slot, sharing the slot with the bag therein. The wall can be lowered by gripping the bag that is extending upward from the slot, but only if the weight of the wall and bags do not cause the bag to separate or pull additional bags through the slot.

U.S. Pat. No. 4,349,123 patented Sep. 14, 1982 by Y. Yang describes a garbage can which includes a series of packaged and folded plastic bags stored in a package box having a slot through which the bags can be pulled up. A horizontal plate which fits the can so that it isolates the top of the can from the bottom of the can, has a slot that is the same length as the package slot, and a frame comprising two L-shaped legs. Each leg has an upright portion with a top end attached to the plate, and a flat base portion which faces the flat base portion of the other leg. The package box containing the bags is slipped between the legs so that the box rests upon the flat base portions. The first bag is fished up through the superimposed slots and drawn up into the can to line the can.

To replace the bags, the operator must reach into the can and hook the horizontal plate by the plate slot and pull up the plate, frame, and empty package box assembly. This is inconvenient because the plate can tilt during the pull-up operation and allow the empty package box to slide off the tilted flat base portions and fall out by one end from between the L-shaped legs, into the bottom of the empty garbage can.

To reload the assembly, the operator draws the first bag from a new package box and fishes it through the plate slot from the bottom up, then slides the box onto the flat base portions. It is advisable to pull the bag as the box is slid in order to avoid the bag bunching up and jamming between the box and the plate slot.

Chen et al., in U.S. Pat. No. 5,031,793, patented Jul. 16, 1991, discloses a hinged, false bottom, horizontal slotted wall, which rotates upward upon hinges attached to one vertical side wall of the basket. When the slotted wall is rotated upward, it reveals a hollow base having three adjacent parallel troughs.

The center trough holds the roll of plastic bags. Another of the troughs holds deodorant, and the third trough holds a waste container for receiving waste water drippings from the litter in the basket on the chance that there is leakage past the bag.

The hinged wall has two slots, one positioned over the center trough for passing the bag up into the basket, and the other slot positioned over the waste water trough for directing drippings into that trough.

In order to restock the trough with plastic bags, the operator must work within the basket. Reaching into the basket, the operator rotates the hinged wall upward. Reaching further down into the basket, the operator inserts a new roll in the center trough and grips the waste water container, and being careful not to tilt it, draws it up and out of the waste basket and empties it. Reaching back into the container, the operator returns the waste water container to the trough, draws a first bag up from the roll and fishes or threads the first bag from the bottom up through the slot, and rotates the hinged wall down.

U.S. Pat. No. 5,115,935 patented May 26, 1992 by R. Lemongelli, describes trash container in which the bottom is formed into a first open top box having side walls square with the bottom wall. A second trapezoidal shaped box has a top panel that is larger than the bottom panel of the second box. The top panel has a pair of parallel slots through which bags can be drawn from the second box. There are two rolls of bags, one roll for each slot. The second box is installed in the trash container by pressing it directly down into the first box. The top of the first box has a plurality of inwardly directed tabs which extend over the top panel of the second box and hold the second box in the first box. The angled sides of the second trapezoidal box help to guide and wedge the second box into the first box by forcing the top panel inward so it can pass the tabs on the way into the first box.

SUMMARY OF THE INVENTION

It is one object of the invention to provide a trash container liner dispensing system which mounts within the trash container.

It is another object of the invention the trash container system be removable from the trash container.

It is another object that the system can be reloaded with a plurality of liners gathered in a roll.

It is another object that the system can be reloaded without removing the system from the trash container.

It is another object that the system does not require a spindle for the gathered liners.

It is another object that the first liner of the roll can be delivered to the trash container without having to fish the bag through a slot in a wall.

It is another object that the system can be reloaded by liners, and the first liner be delivered to the trash area of the trash container in a single lateral movement of the roll and first liner.

Other objects and advantages will become apparent to a reader upon reading the ensuing description of the invention.

A container liner dispensing system includes a waste container having a bottom wall and a circumferential vertical wall attached to the bottom wall forming an enclosure. And, a panel mounted on a base, the panel includes molded as a unit with the panel a first fastener means. The panel and base together are removably mounted in the waste container. The base includes molded as a unit with the base a trough and second fastener means aligned with the first fastener means for fastening the panel on the base. The panel and the trough together form a tube having a length, an axis, a first open end and a blocked second end. The panel includes a slot through the panel over the trough generally lengthwise with the tube, the slot having a first end that is open through an end of the panel, and having a second end. The panel extends axially beyond the open first end of the tube. The first end of the slot extends beyond the open end of the tube. The panel includes a finger hole through the panel adjacent to the slot beyond the open end of the tube for rotating the first end of the slot upward. A plurality of liner bags joined end to end in a strip and gathered in a roll having an outer curve of predetermined diameter are in the tube. The bottom of the trough comprises a curve that in cross section closely approaches a portion of the outer curve of predetermined diameter.

BRIEF DESCRIPTION OF THE DRAWINGS

In order that the invention be more fully comprehended, it will now be described, by way of example, with reference to the accompanying drawings, in which:

FIG. 2 is a perspective view of the liner system of FIG. 1.

FIG. 3 is a bottom view of the liner system of FIG. 2.

FIG. 4 is a partial cross section view of the liner system latch viewed along 4—4 in FIG. 2.

DESCRIPTION OF THE PREFERRED EMBODIMENTS

Figure 1:
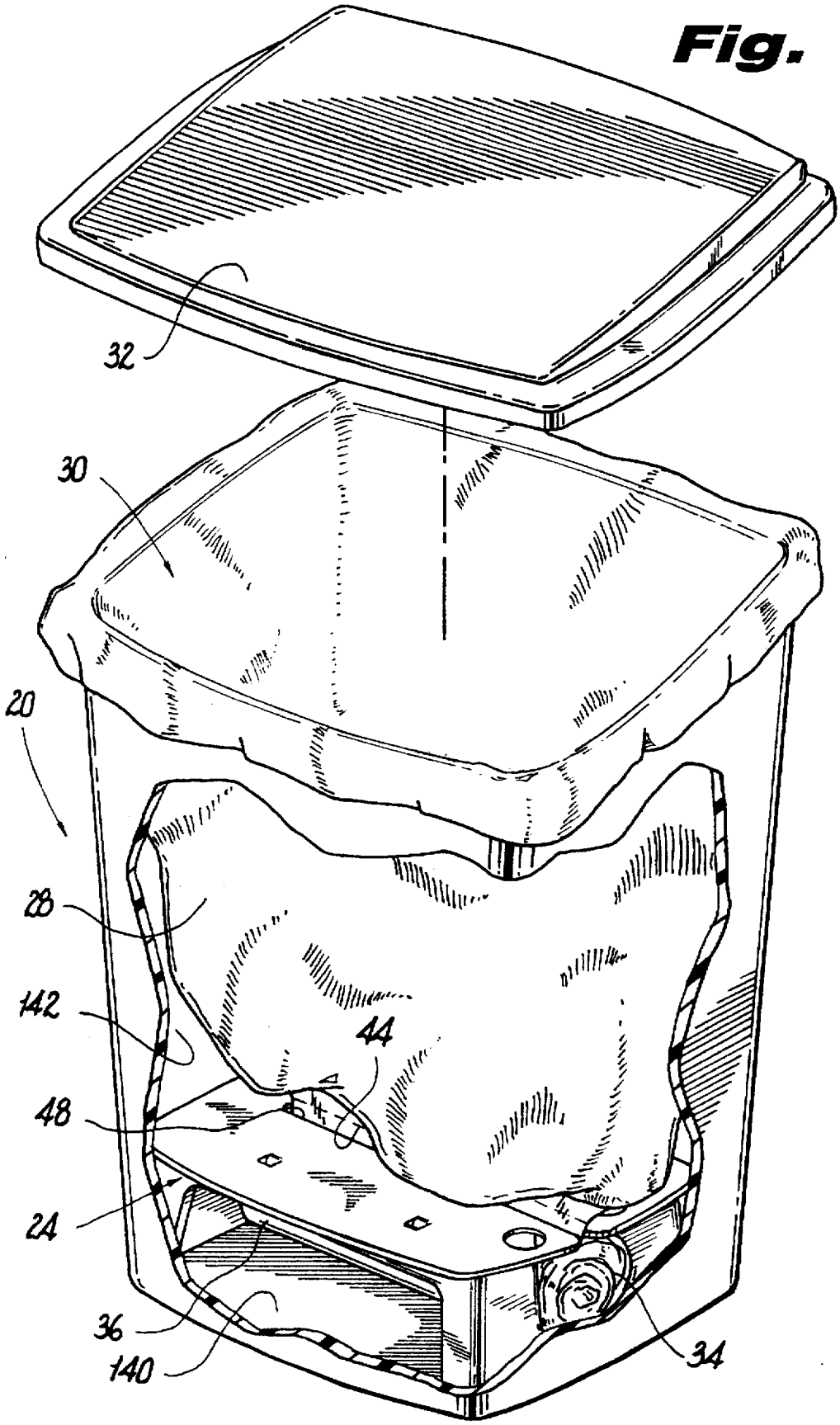
FIG. 1 is a perspective view of a lined trash container with the trash container liner system of the invention. A portion of the trash container is cut away to show the liner system.
Figure 5:
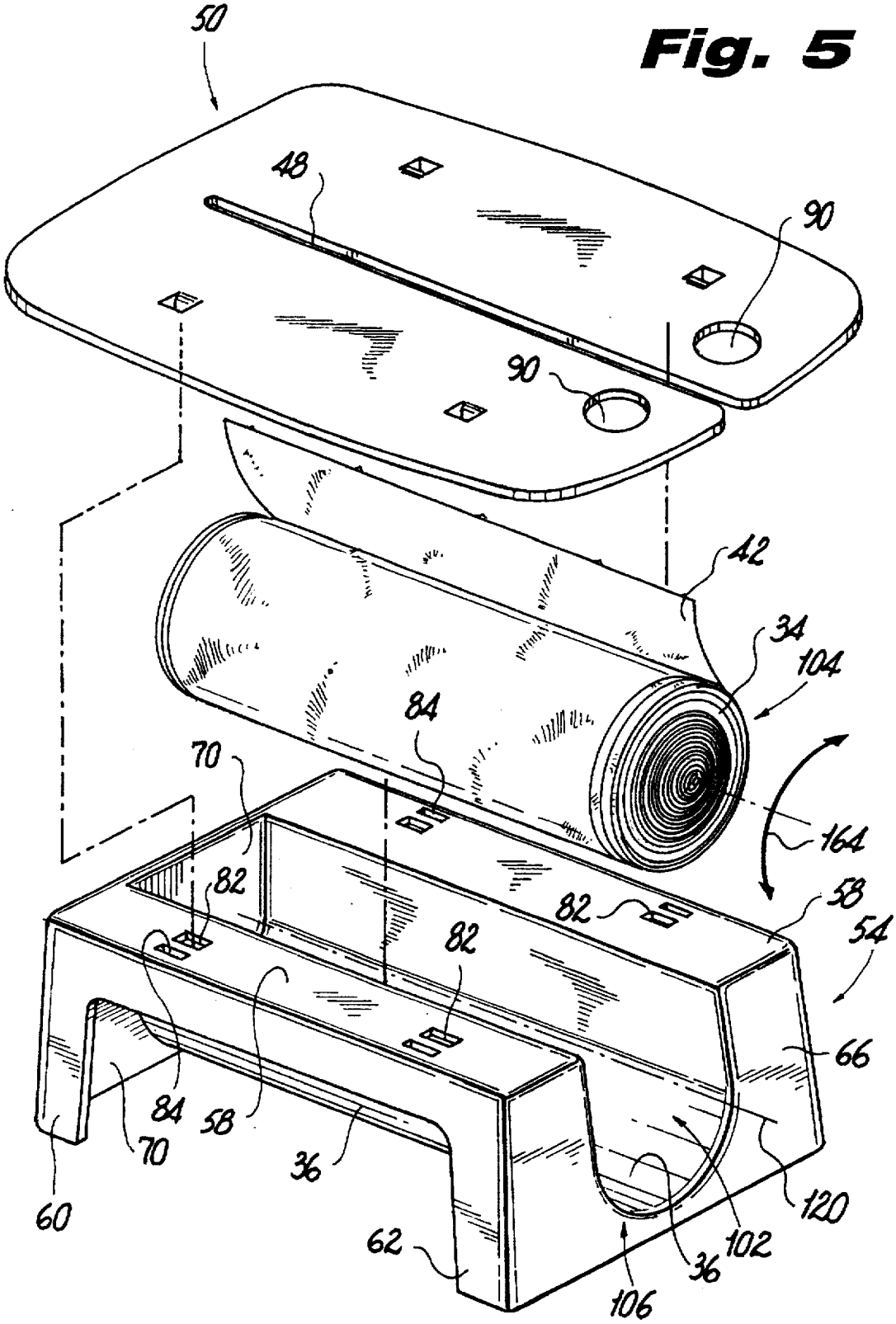
FIG. 5 is an exploded perspective schematic view of the system of FIG. 2.
Figure 7:
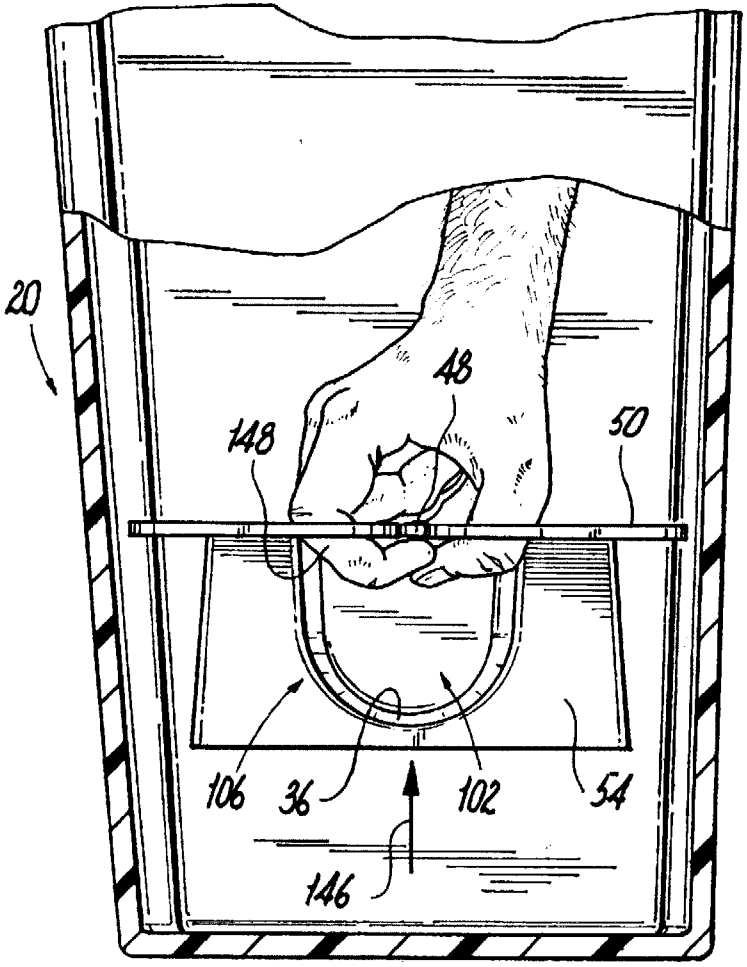
FIG. 7 is a right-side view of the trash container with liner system of FIG. 6 after the liners contained in the system are used out, and the system is being tilted up by an operator's hand for reloading the system with a new supply of liners.
Figure 6:
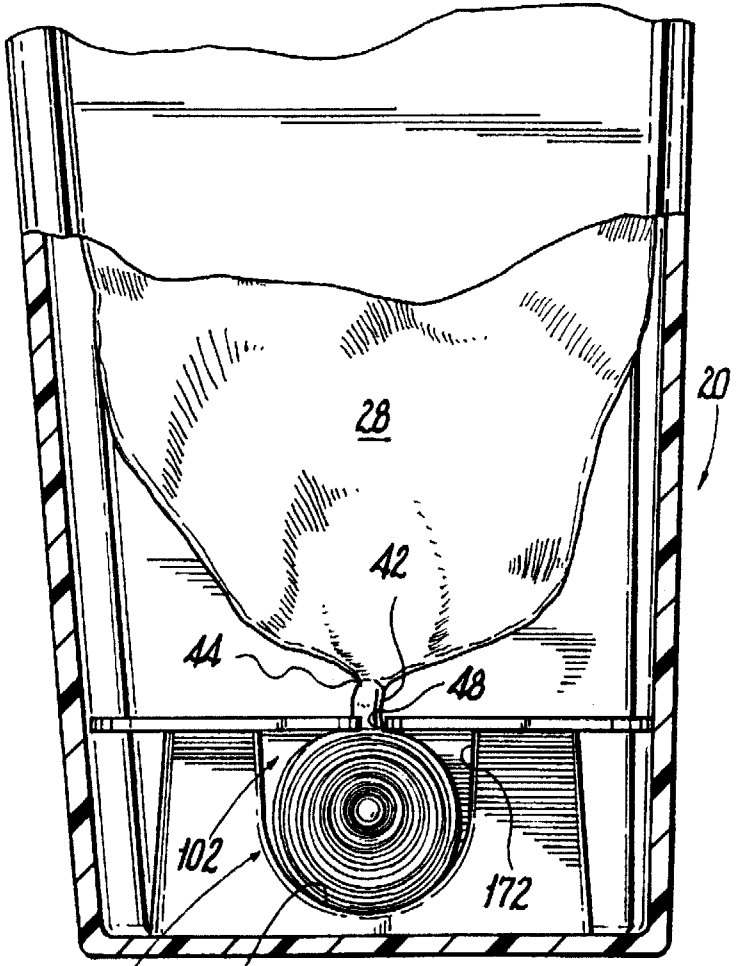
FIG. 6 is a right-side view of the trash container with liner system of FIG. 1. A portion of the trash container is cut away to show the liner system.
Figure 8:
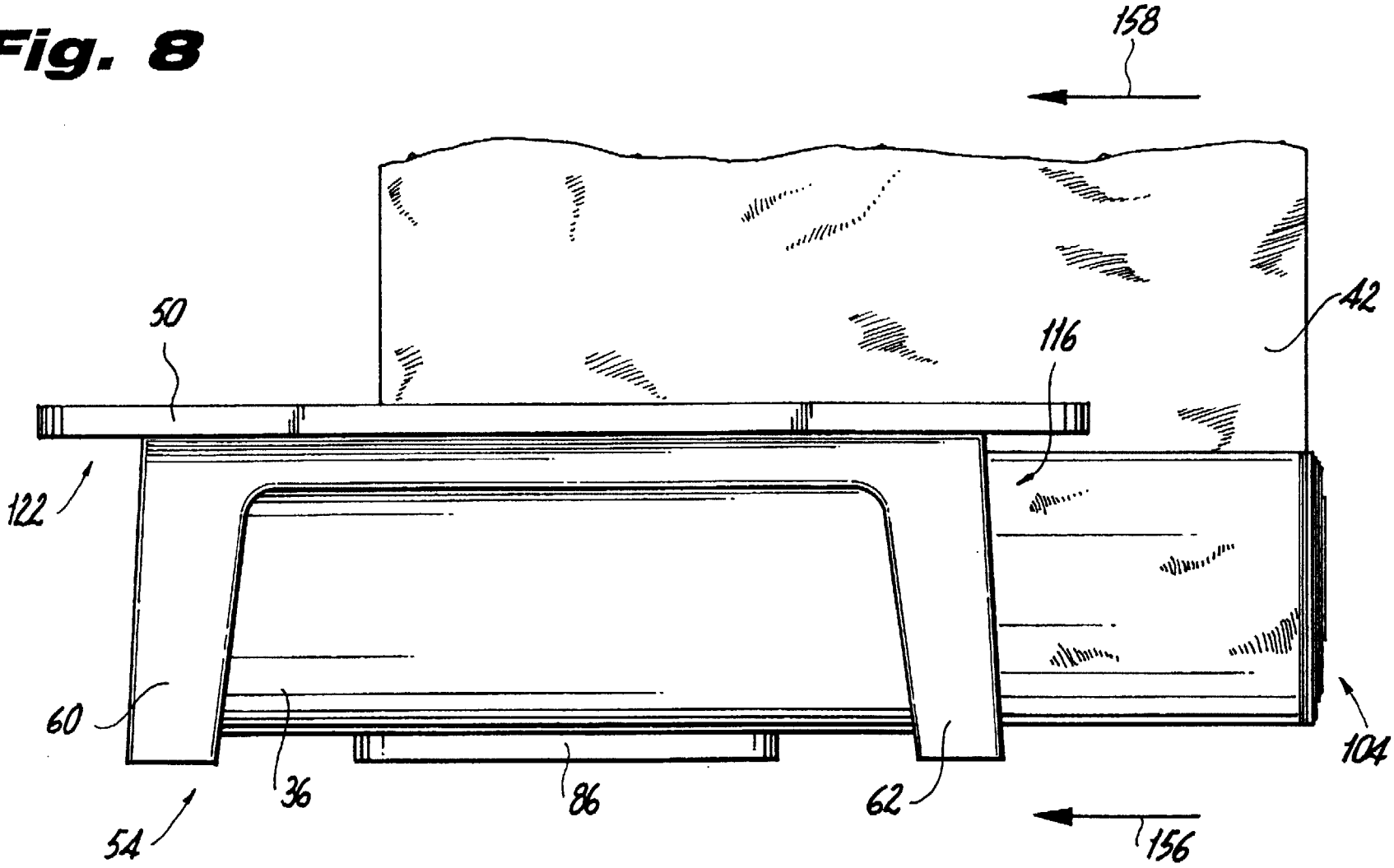
FIG. 8 is a front view of the system of FIG. 2.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIG. 1, trash container 20 includes liner dispensing system 24 which supplied liner bag 28 to the trash container interior for lining 30 the container. Cover 32 fits over the container wrapped with the liner, for sealing the lined container.

Liner bag 28 is one of a plurality of liner bags 34 joined end to end in a strip 42 gathered within trough 36 of the system. Preferably the liners are gathered in a roll, for reasons which will be explained later.

The back end of bag 28 is separable from strip 42 at perforate line 44. When bag 28 is full, the bag is pulled upward out of container 20. As bag 28 is pulled upward, it drags the next bag from the trough by way of slot 48. Bag 28 is then torn from the strip at the perforation which leaves the top end of the next bag open and ready for lining the container.

In FIGS. 2, 3, 4, 5, and 8, liner dispensing system 24 includes panel 50 and base 54, both preferably made from plastic. Base 50 includes in molded as one with the base, horizontal shoulders 58 supported by front and back vertical legs 60, 62, 64, and 66, and vertical walls 68 and 70, trough 36, latch openings 82, position bar openings 84, and foot 86. Preferably foot 86 is sealed by trough 36, but may contain an opening through the trough within the confines of wall 88 of the foot.

Panel 50 includes molded as one with the panel, downward depending 92 position bars 96, downward depending flexible latch finger 98, and finger openings 90.

Referring to FIGS. 5, 6, 7, and 8, plurality of liner bags 34 are packaged in a roll 104 of predetermined diameter and length. The bags 34 do not need or require a central shaft or arbor for loading, storage or support in liner dispensing system 24.

Panel 50 snaps onto base 54 and is held immovable on base 54 by position bars 96 in position bar openings 84, and latch fingers 98 in latch openings 82. Panel 50 and trough 36 form a tube 102 that is a covered U in cross section. The tube is open at one end, and blocked at the other end by vertical wall 70. The cover of the U is flat, is formed by panel 50, and extends axially beyond 116 the open end 106 and axially beyond 122 blocked end 108 the tube.

Slot 110 is longer than the tube. It extends from the blocked end of tube 102 axially beyond 118 the open end 106 of tube 102. Preferably the slot is parallel with axis 120 of the tube, and bisects the top 130 of opening 132 of open end 106.

System 24 is assembled by snapping panel 50 on base 54. It is inserted into the bottom of trash container 20 wherein it rests with the vertical legs, vertical walls and foot on bottom wall 140 of container 20. Preferably panel 50 closely fits to vertical wall 142 around container 20 so that lateral movement of the panel within container 20 is minimal.

The position bar and latch finger are preferred fastening means. Other fastening means molded as a unit may be openings for fastening hardware such as bolts and nuts.

Reloading of system 24 with bags is convenient and quick. System 24 is tilted upward 146 by gripping panel 50 by fingers 148 through finger openings 90 and pulling that end of the panel upward. This exposes open end 106 of the tube and open end 150 of slot 110. A new roll 104 is inserted 156 into the open end of the tube and simultaneously the end of the strip 42 comprising the first bag on the roll is inserted 158 into the open end of the slot. There is no need to fish the first bag through a slot of restricted length. After the roll and strip is slid into system to the blocked end of the tube, the panel is let down by the fingers until the system is at rest in the bottom of the trash container.

The blocked end of the tube may be blocked by blocking means such as tabs or other means that will prevent movement of the roll completely through the tube, rather than a wall that completely covers the end of the tube as wall 70.

Preferably the bottom of the tube is curved 162 to closely fit the curve 164 of a full roll so that there is a small space between the full roll and the sides 172, 174. This keeps the turning roll generally centered below slot 110, and resists climbing of the roll up wall 172 or 174 as it rotates when a bag is being drawn through slot 110 from the tube. Walls 172 and 174 may be made to curve inward adjacent to panel 50 in one embodiment of the invention, although it is easier to mold them vertically straight which is the preferred embodiment.

As there is no spindle required for holding or dispensing the bags, the system will dispense bags from a strip of bags that is folded, such as for example in an accordion fold. The folded group of bags can be loaded into the tube as explained above for the roll of bags.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A container liner dispensing system comprising:

a base, a panel, said panel being mounted on said base and comprising molded as a unit with said panel a first fastener means, said base comprising molded as a unit with said base a trough having a first end, a second end, a top, and second fastener means aligned with said first fastener means on said panel for fastening said panel on said base, said panel and said trough together forming a tube having a length, an axis, an open first end and a blocked second end, said panel comprising a slot through said panel over said trough generally lengthwise with said tube, said slot having a first end that is open through an end of the panel, and a second end that is closed.

2. The system of claim 1, wherein:

said second end of said slot is adjacent to said blocked second end.

3. The system of claim 2 wherein said slot is longer than the length of said tube.

4. The system of claim 2, wherein:

said first end of said slot extends beyond the open end of said tube.

5. The system of claim 4, further comprising:

a finger hole through said panel adjacent to said slot beyond the open end of said tube.

6. A container liner dispensing system comprising:

a base, a panel, said panel being mounted on said base and comprising molded as a unit with said panel a flexible latch finger extending from said panel, said base comprising molded as a unit with said base a trough having a first end, a second end, a first side, a second side, a top, a bottom, a first shoulder on said first side, a second shoulder on said second side, and a receiver for said flexible latch finger aligned with said flexible latch finger for fastening said panel on said base, said panel being mounted on the first and second shoulders, and forming with said trough a tube having a length, an axis, an open first end and a blocked second end, said panel comprising a slot through said panel over said trough generally parallel with said axis, said slot having a first end that is open through an end of the panel and a second end that is closed, means molded on said panel for aligning said panel with said base when said panel is fastened on said base.

7. The system of claim 6, wherein:

said slot extends beyond the open end of said tube.

8. A container liner dispensing system comprising:

A waste container having a bottom wall, and a circumferential vertical wall attached to said bottom wall forming an enclosure having a top and a bottom, a base, a panel, said panel being mounted on said base and comprising molded as a unit with said panel a first fastener means, said panel and base together being removably mounted in said waste container, said base comprising molded as a unit with said base a trough having a first end, a second end, a top, a bottom, and second fastener means aligned with said first fastener means on said panel for fastening said panel on said base, said panel and said trough together forming a tube having a length, an axis, an open first end and a blocked second end, said panel comprising a slot through said panel over said trough generally lengthwise with said tube, said slot having a first end that is open through an end of the panel and a second end.

9. The system of claim 8, wherein:

said panel extends axially beyond the open first end of said tube.

10. The system of claim 8, wherein:

said first end of said slot extends beyond the open end of said tube.

11. The system of claim 8, further comprising:

a finger hole through said panel adjacent to said slot beyond the open end of said tube for rotating said first end of said slot upward.

12. The system of claim 8, further comprising:

plurality of liner bags joined end to end in a strip and gathered in a roll having an outer curve of predetermined diameter, in said tube, the bottom of said trough comprising a curve that in cross section closely approaches a portion of the outer curve of predetermined diameter.

* * * * *